US012428120B1

(12) United States Patent
Lubitz et al.

(10) Patent No.: US 12,428,120 B1
(45) Date of Patent: Sep. 30, 2025

(54) SYSTEMS AND METHODS FOR SHIFTING A MULTI-SPEED TRANSMISSION

(71) Applicant: Brunswick Corporation, Mettawa, IL (US)

(72) Inventors: Charles A. Lubitz, Fond du Lac, WI (US); David M. Van Buren, Fond du Lac, WI (US); Matthew W. Snyder, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 820 days.

(21) Appl. No.: 17/667,247

(22) Filed: Feb. 8, 2022

Related U.S. Application Data

(60) Provisional application No. 63/147,971, filed on Feb. 10, 2021.

(51) Int. Cl.
*B63H 23/02* (2006.01)
*B63H 23/30* (2006.01)
*B63H 20/00* (2006.01)

(52) U.S. Cl.
CPC ..... *B63H 23/02* (2013.01); *B63H 23/30* (2013.01); *B63H 20/00* (2013.01); *B63H 2023/0266* (2013.01)

(58) Field of Classification Search
CPC ..... B63H 23/02; B63H 23/30; B63H 20/00; B63H 2023/0266; B60K 6/36; F16H 2200/2038; F16H 2200/003; F16H 2059/683; F16H 2059/6861; F16H 2059/702; F16H 61/0204; F16H 61/0213; F16H 2061/0209; F16H 2061/0234; F16H 61/02055; F16H 61/061; F16H 61/08
See application file for complete search history.

(56) References Cited

U.S. PATENT DOCUMENTS 4,331,432 A * 5/1982 Blanchard ..... F16H 3/10 74/336 R
4,380,278 A * 4/1983 Lasken ..... F16H 59/68 192/48.601
5,711,742 A 1/1998 Leinonen et al.
6,200,177 B1 3/2001 Scott et al.
(Continued)

OTHER PUBLICATIONS

U.S. Appl. No. 16/733,825, filed Jan. 3, 2020, first named inventor Matthew Snyder.

*Primary Examiner* — Farhana Pervin
(74) *Attorney, Agent, or Firm* — Andrus Intellectual Property Law, LLP

(57) ABSTRACT

A method for shifting a multi-speed transmission of a marine propulsion device from a first gear being engaged to a second gear being engaged by selectively filling a first clutch and a second clutch with a fluid. The method includes operating the marine propulsion device with the second gear disengaged and controlling the second clutch to perform a first prefill in which fluid is injected into the second clutch to partially fill the second clutch while the second gear remains disengaged. The method further includes receiving, after the first prefill, a request to shift from the first gear to the second gear and subsequently increasing a pressure in the second clutch to cause the second gear to engage and decreasing a pressure in the first clutch to cause the first gear to disengage to thereby shift the multi-speed transmission.

20 Claims, 8 Drawing Sheets

| | C1 | C2 | CR |
|---|---|---|---|
| R REVERSE | OPEN | OPEN | CLOSED |
| N NEUTRAL | OPEN | OPEN | OPEN |
| F1 FORWARD 1 | CLOSED | OPEN | OPEN |
| F2 FORWARD 2 | OPEN | CLOSED | OPEN |

(56) References Cited

U.S. PATENT DOCUMENTS

| | | | | |
|---|---|---|---|---|
| 6,273,771 | B1 | 8/2001 | Buckley et al. | |
| 7,891,263 | B2 * | 2/2011 | Mowbray | B63H 20/14 74/330 |
| 9,011,287 | B2 | 4/2015 | Meyer et al. | |
| 9,446,829 | B1 | 9/2016 | Williams et al. | |
| 9,676,483 | B2 | 6/2017 | Godecker et al. | |
| 9,718,529 | B2 | 8/2017 | Williams et al. | |
| 10,124,874 | B1 * | 11/2018 | Jaeger | F16H 3/44 |
| 10,766,592 | B1 * | 9/2020 | Przybyl | F16H 61/68 |
| 10,800,502 | B1 | 10/2020 | Alby et al. | |
| 10,995,824 | B1 | 5/2021 | Bielefeld et al. | |
| 11,203,401 | B1 | 12/2021 | Bielefeld et al. | |
| 2005/0133334 | A1 | 6/2005 | Whitton et al. | |
| 2018/0057134 | A1 * | 3/2018 | Ebihara | B63H 23/30 |
| 2020/0032897 | A1 * | 1/2020 | Slayton | F15B 1/033 |
| 2021/0033189 | A1 * | 2/2021 | Shariatmadar | F16H 59/40 |
| 2021/0245856 | A1 * | 8/2021 | De Ceglia | B63H 23/08 |

* cited by examiner

| | C1 | C2 | CR |
|---|---|---|---|
| R REVERSE | OPEN | OPEN | CLOSED |
| N NEUTRAL | OPEN | OPEN | OPEN |
| F1 FORWARD 1 | CLOSED | OPEN | OPEN |
| F2 FORWARD 2 | OPEN | CLOSED | OPEN |

SYSTEMS AND METHODS FOR SHIFTING A MULTI-SPEED TRANSMISSION

CROSS REFERENCE TO RELATED APPLICATION

This application claims the benefit of U.S. Provisional Patent Application No. 63/147,971, filed Feb. 10, 2021, which is incorporated herein by reference in its entirety.

FIELD

The present disclosure generally relates to shifting a transmission for a marine propulsion device, and more particularly to shifting a multi-speed transmission.

BACKGROUND

The following U.S. Patents and Patent Applications provide background information and are incorporated by reference in entirety.

U.S. Pat. No. 5,711,742 discloses a marine propulsion system, preferably having dual counterrotating propellers, which has an automatic multi-speed shifting mechanism such as a transmission. An electronic controller monitors engine parameters, such as engine revolution speed and load, and generates a control signal in response thereto, which is used to control shifting. Engine load is preferably monitored by sensing engine manifold air pressure. The electronic controller preferably has a shift parameter matrix stored within a programmable memory for comparing engine speed and engine load data to generate the control signal. The system can also have a manual override switch to override shifting of the shifting mechanism.

U.S. Pat. No. 6,200,177 discloses a marine propulsion system which is provided with a gear shifting apparatus and method that changes a transmission from a low gear to a high gear, and vice versa, based solely on the engine speed. Engine speed is measured and a rate of change of engine speed is determined as a function of the actual change in engine speed over a measured time interval. Several threshold magnitudes are preselected and used to define one or more engine speed ranges. At least one threshold magnitude is used to compare the actual rate of change of engine speed to a preselected value. Both up shifting and down shifting of a transmission are controlled as a function of engine speed and rate of change of engine speed.

U.S. Pat. No. 11,203,401 discloses a transmission for an outboard motor, the transmission having an input shaft with an input gear non-rotatably fixed thereto and rotatable by an engine. A countershaft has a countershaft driven gear and a reverse driving gear non-rotatably fixed thereto, where the countershaft driven gear meshes with the input gear. An output shaft has first and second driven gears non-rotatably fixed thereto. First and second driving gears mesh with the first and second driven gears, a reverse idler gear meshes with the reverse driving gear, and a reverse driven gear meshes with the reverse idler gear. First and second clutches selectively rotate the first and second driving gears with the countershaft in first and second gears at first and second speeds in forward rotation, respectively, and a reverse clutch selectively rotates the output shaft with the reverse driven gear in reverse with reverse rotation.

U.S. Pat. No. 10,995,824 discloses a transmission for an outboard motor, the transmission having an input shaft with an input gear. A countershaft has a countershaft driven gear and a reverse driving gear, where the countershaft driven gear meshes with the input gear. An output shaft has first and second driven gears. First and second driving gears mesh with the first and second driven gears. A reverse idler gear meshes with the reverse driving gear and also with a reverse driven gear. A plurality of clutches includes first, second, third, and reverse clutches. The first and second clutches selectively rotate the first and second driving gears with the countershaft in first and second gears in forward rotation, respectively. The third clutch selectively rotates the second driving gear with the input shaft in a third gear in forward rotation. The reverse clutch selectively rotates the output shaft with the reverse driven gear in reverse rotation.

U.S. patent application Ser. No. 16/733,825 discloses a method for synchronizing shifting of transmissions across marine propulsion devices. The method includes receiving a signal to shift the transmissions and identifying a predetermined shifting time for each of the transmissions, where the predetermined shifting time represents an elapsed time between starting the shifting and completing the shifting. The method further includes comparing the predetermined shifting times to determine a longest shifting time, calculating for each of the transmissions an offset time that is a difference between the corresponding predetermined shifting time and the longest shifting time, and sending a signal to start the shifting of each of the transmissions after waiting the offset time for that transmission such that the transmissions all complete the shifting at the same time.

U.S. Pat. No. 9,446,829 discloses a transmission for an outboard marine engine. The transmission comprises a rotatable input shaft that is rotated by an internal combustion engine, a rotatable output shaft that powers a propulsor, a forward gear that causes forward rotation of the output shaft and propulsor, a reverse mode that causes reverse rotation of the output shaft and propulsor, a clutch that is movable between a forward clutch position wherein the forward gear causes the forward rotation of the output shaft and propulsor and a reverse clutch position wherein the reverse mode causes the reverse rotation of the output shaft and propulsor, and an internal ring gear that couples the output shaft to one of the forward gear and the reverse mode.

U.S. Pat. No. 9,676,463 discloses a transmission for a marine propulsion device having an internal combustion engine that drives a propulsor for propelling a marine vessel in water. An input shaft is driven into rotation by the engine. An output shaft drives the propulsor into rotation. A forward planetary gearset that connects the input shaft to the output shaft so as to drive the output shaft into forward rotation. A reverse planetary gearset that connects the input shaft to the output shaft so as to drive the output shaft into reverse rotation. A forward brake engages the forward planetary gearset in a forward gear wherein the forward planetary gearset drives the output shaft into the forward rotation. A reverse brake engages the reverse planetary gearset in a reverse mode wherein the reverse planetary gearset drives the output shaft into the reverse rotation.

U.S. Pat. No. 9,718,529 discloses a marine transmission located within drive housing that includes a torque transmitting gear set and a clutch mechanism. The torque transmitting gear set includes top and bottom bevel gears and opposing side idler bevel gears mounted to a pinion shaft. The pinion shaft is mounted on a carrier and the clutch mechanism engages the carrier to rotate with the input shaft to drive the output shaft in the forward direction and engages the carrier to a reaction plate fixed to the drive housing to drive the output shaft in the reverse direction.

U.S. Pat. No. 10,800,502 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for shifting a multi-speed transmission of a marine propulsion device from a first gear being engaged to a second gear being engaged by selectively filling a first clutch and a second clutch with a fluid. The method includes operating the marine propulsion device with the second gear disengaged and controlling the second clutch to perform a first prefill in which fluid is injected into the second clutch to partially fill the second clutch while the second gear remains disengaged. The method further includes receiving, after the first prefill, a request to shift from the first gear to the second gear and subsequently increasing a pressure in the second clutch to cause the second gear to engage and decreasing a pressure in the first clutch to cause the first gear to disengage to thereby shift the multi-speed transmission.

Another embodiment generally relates to a multi-speed transmission for a marine propulsion device, the multi-speed transmission being configured to transmit torque from a powerhead to a propulsor. A first gear and a second gear are each engageable to transmit the torque between the powerhead and the propulsor. A first clutch is configured to engage the first gear when a pressure in the first clutch reaches a first engagement threshold. A second clutch is configured to engage the second gear when a pressure in the second clutch reaches a second engagement threshold. A control system is operatively coupled to the first clutch and the second clutch, wherein the control system is configured to control the pressure in the first clutch and in the second clutch. The control system is further configured to control the second clutch, while the second gear is disengaged, to perform a first prefill in which fluid is injected into the second clutch to partially fill the second clutch while the second gear remains disengaged. The control system is further configured to receive, after the first prefill, a request to shift to the second gear and to subsequently increase the pressure in the second clutch to cause the second gear to engage and decrease the pressure in the first clutch to cause the first gear to disengage to thereby shift the multi-speed transmission.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
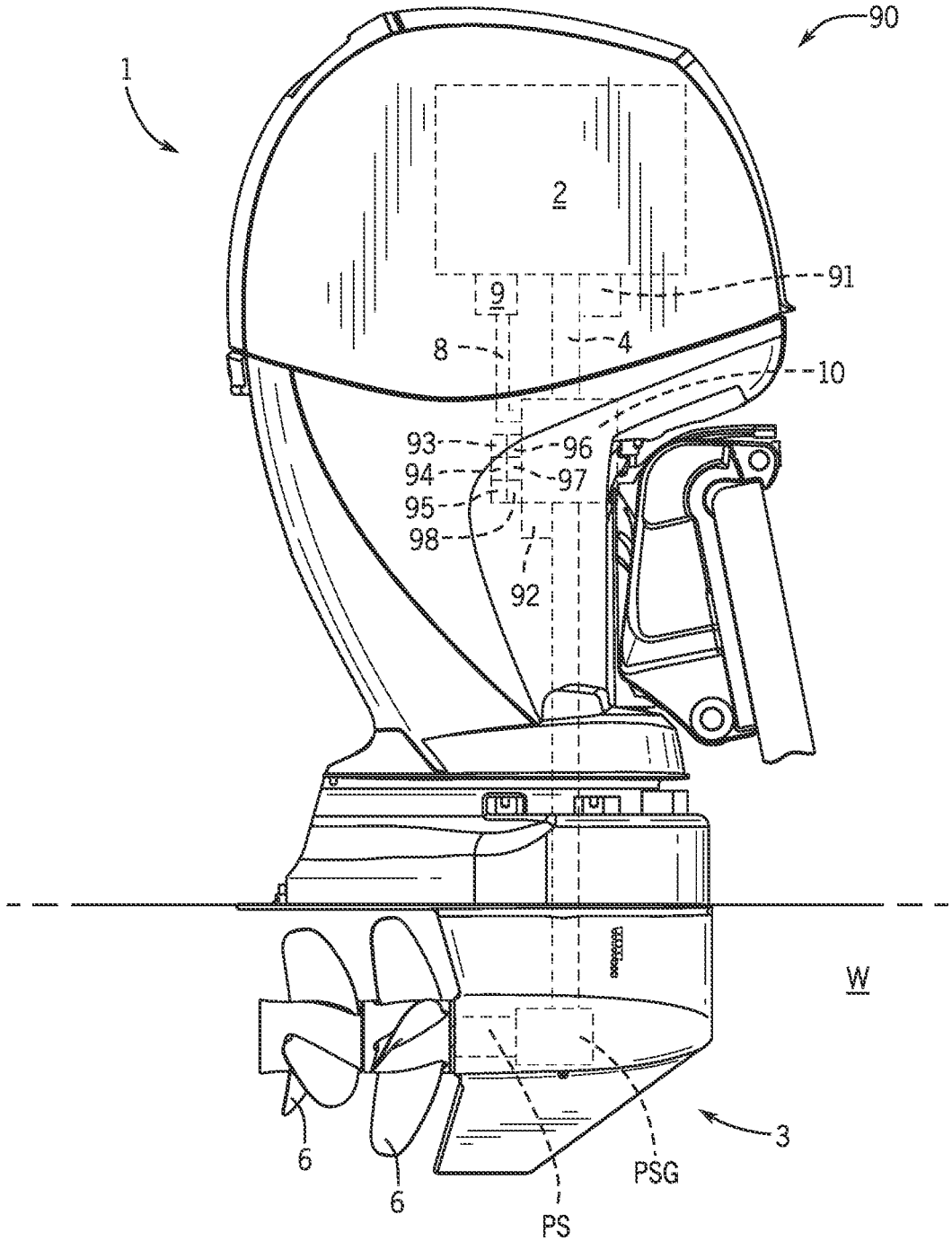
FIG. 1 is a side view of an exemplary marine propulsion device according to the present disclosure.

The present disclosure generally relates to systems and methods for shifting multi-speed transmissions (i.e., transmissions having more than one forward gear) used with marine propulsion devices. FIG. 1 depicts an exemplary marine propulsion device 1 incorporating a system 90 according to the present disclosure. The marine propulsion device 1 includes a powerhead 2 configured to rotate a driveshaft 4, which through a transmission 10 (discussed below), as well as a propeller shaft gearset PSG and a propeller shaft PS contained within a gearcase 3, is operational to rotate one or more propulsors (here propellers 6) to propel a vessel through the water W. Exemplary powerheads 2 include electric motors, internal combustion engines (e.g., gasoline or diesel engines), hybrids, or combinations thereof. An RPM sensor 91 is operatively coupled to the driveshaft 4 to detect a rotational speed (also referred to as an RPM) of the driveshaft 4 in a manner known in the art. The transmission 10 is operable via a clutch actuator 8, which is controlled by a controller 9 to effectuate shifting within the transmission 10. For simplicity, a single clutch actuator 8 is referenced for controlling all clutches in the transmission 10, though it should be recognized that multiple individual clutch actuators may be used in practice. In the examples provided below, the clutches are hydraulically operated, whereby an electrical current provided by the controller 9 to the clutch actuator 8 causes the pressure of a fluid within a given clutch to increase until eventually causing that clutch to engage in a manner known in the art. Other types of clutches are also contemplated by the present disclosure.

The following are examples of components that may be used in present or altered form for the presently disclosed systems and methods: Multidisc clutch packs presently used in outboard engines, such as in Mercury Marine's® Zeus 3000 transmission part number 879148T69 or Mercury Marine's® ZF transmission part number ZF 105 S; a controller such as Mercury Marine® TVM part number 8M0079409 (also used with the Zeus 3000 transmission), and solenoid valves such as Bosch® DRE05SK. Other examples may also be taken from existing Mercury Marine® or other propulsion devices and/or are also be known in the art.

Figure 2:
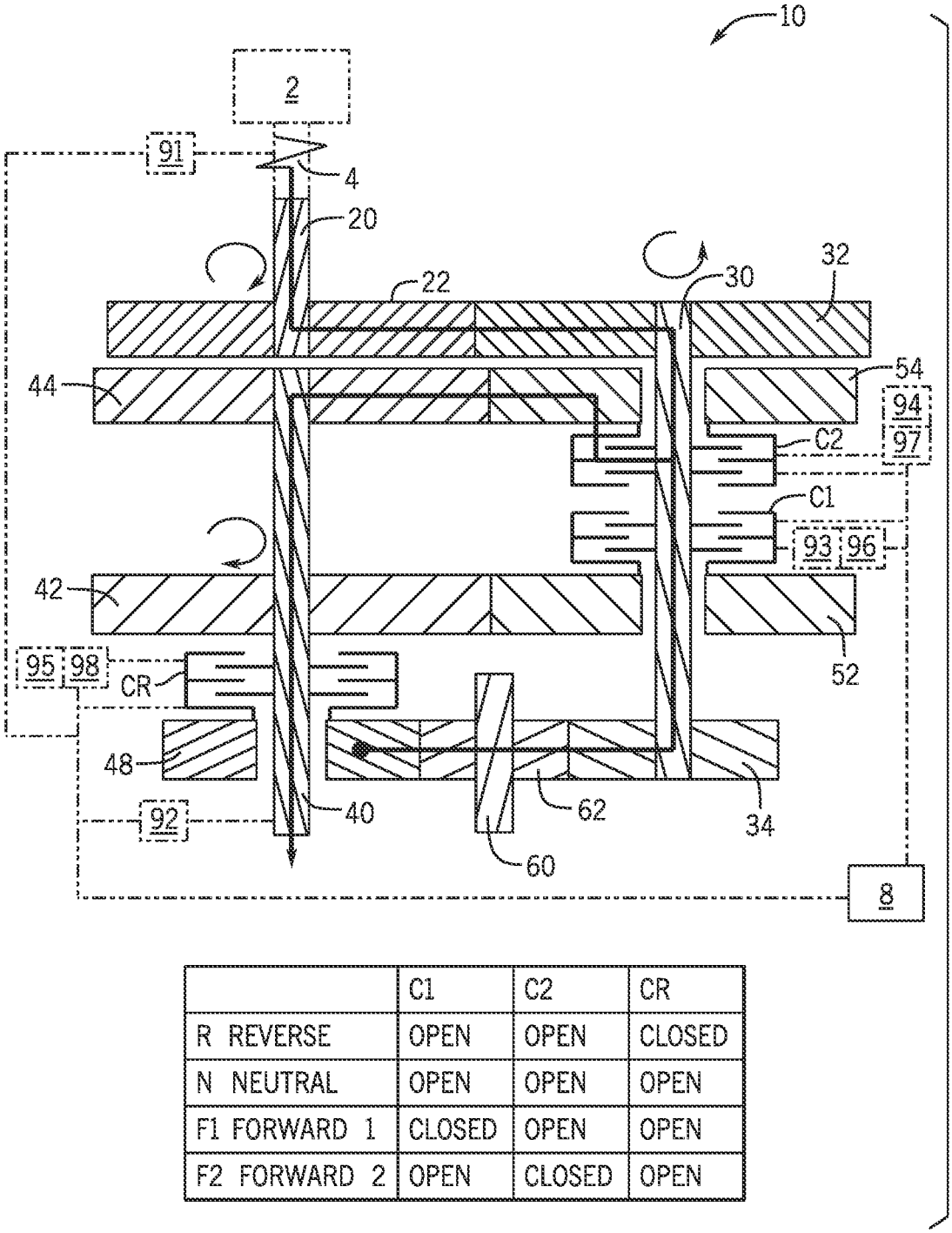
FIG. 2 is a schematic view of an exemplary multi-speed transmission according to the present disclosure having two forward speeds.

FIG. 2 depicts an exemplary embodiment of a multi-speed transmission, here a transmission 10 having first and second gears corresponding to two forward speeds according to the present disclosure. Additional information regarding transmissions can be found in SAE International's "Design Practices: Passenger Car Automatic Transmissions" (Fourth Edition, Product Code AE-29, 2012) and SAE International's "Dynamic Analysis and Control System Design of Automatic Transmissions" (2013), which are each incorporated by reference herein. While the present disclosure focuses primarily on two-speed transmissions, it should be recognized that transmissions having more speeds are equally applicable.

The transmission 10 of FIG. 2 has an input shaft 20 that is configured to be coupled to the driveshaft 4 rotated by the powerhead 2. In this manner, the input shaft 20 is caused to rotate whenever the powerhead 2 is operating. While the input shaft 20 of the transmission 10 is shown here to be physically connected to the driveshaft 4, it should be recognized that the transmission 10 may be positioned anywhere between the driveshaft 4 and the propeller 6 to translate rotatable power therebetween.

The input shaft 20 of the transmission 10 has an input gear 22 that is non-rotatably fixed thereto such that the input gear 22 and input shaft 20 rotate together. The input gear 22 meshes with a countershaft driven gear 32, which is non-rotatably fixed to a countershaft 30. In this manner, the input shaft 20 and the countershaft 30 are configured to rotate in opposite directions. A reverse driving gear 34 is also non-rotatably fixed to the countershaft 30 such that the reverse driving gear 34 also rotates in a direction opposite of the input shaft 20. In the embodiment shown, the countershaft 30 is parallel to the input shaft 20.

The transmission 10 further includes an output shaft 40 having a first driven gear 42 and also a second driven gear 44 that are each non-rotatably fixed to the output shaft 40. The first driven gear 42 meshes with a first driving gear 52 that is selectively engageable with the countershaft 30 via engagement of a first clutch C1. Similarly, the second driven gear 44 meshes with a second driving gear 54 that, similarly to the first driving gear 52, is selectively engageable with the countershaft 30 via a second clutch C2. When the first clutch C1 is engaged, the first driving gear 52 is caused to rotate by the countershaft 30. Similarly, when the second clutch C2 is engaged, the second driving gear 54 is caused to rotate by the countershaft 30. A transmission output shaft speed (TOSS) sensor 92 is operatively coupled to the output shaft 40 of the transmission 10 to measure an RPM of the output shaft 40 in a manner known in the art.

With continued reference to FIG. 2, the first clutch C1 and second clutch C2 may be selectively engaged or actuated via clutch actuators 8, which may include mechanical and/or electronic means for engagement of the clutches. Additional information regarding the controller 9 for operating the transmission 10 is provide below (which, for example, may be the control system 100 of FIG. 8).

With continued reference to FIG. 2, the transmission 10 includes a reverse idler gear 62 that is supported by and rotates with a reverse idler shaft 60. The reverse idler gear 62 meshes with the reverse driving gear 34 coupled to the countershaft 30 so as to rotate therewith. The reverse idler gear 62 further meshes with a reverse driven gear 48 that is selectively engageable with the output shaft 40 by engagement via a reverse clutch CR. The reverse clutch CR is also operable through use of the clutch actuator 8 in the manner previously described for the first clutch C1 and second clutch C2.

In this manner, the first clutch C1 selectively rotates the first driving gear 52 with the countershaft 30, the second clutch C2 selectively rotates the second driving gear 54 with the countershaft 30, and the reverse clutch CR selectively rotates the output shaft 40 with the reverse driven gear 48. By selectively engaging the first clutch C1, second clutch C2, and/or reverse clutch CR, the transmission 10 is shiftable between a first forward mode (also referred to as first gear F1) in which the output shaft 40 rotates in a forward direction at a first speed relative to a speed of the input shaft 20, a second forward mode (also referred to as second gear F2) with rotation of the output shaft 40 in the forward direction at a second speed relative to a speed of the input shaft 20 that is different than the first speed, and also a reverse mode (also referred to as reverse gear R) in which the output shaft 40 rotates in reverse rotation that is opposite of the forward direction (i.e., opposite the input shaft 20). The transmission 10 also has a neutral mode (also referred to as neutral N) in which rotation of the input shaft 20 does not cause rotation of the output shaft 40.

FIG. 2 further incorporates a table showing the combination of engaged and disengaged clutches corresponding to each of the modes for operating the transmission 10. In the first gear F1, only the first clutch C1 is closed, or in other words, the second clutch C2 and the reverse clutch CR are open. Similarly, in the second gear F2, only the second clutch C2 is closed, with the first clutch C1 and the reverse clutch CR being open. The transmission 10 is in reverse R when only the reverse clutch CR is engaged, and in neutral N when none of the clutches are engaged.

It should be recognized that the difference in the gear ratio between the first driving gear 52 and first driven gear 42, as compared to between the second driving gear 54 and the second driven gear 44, dictates the rotational speed of the output shaft 40 relative to the input shaft 20. Other configurations of multi-speed transmissions are also contemplated by the present disclosure, including those have more than two forward gears.

The present inventors have recognized that while incorporating a multi-speed transmission within a marine propulsion device can improve acceleration, efficiency, and general performance for propelling a marine vessel, new challenges arise from the need to shift between forward gears. Specifically, the present inventors have recognized a problem with the performance and the noise, vibration, and harshness (NVH) of the marine propulsion device 1 when upshifting from a first gear F1 to a second gear F2 as compared to shifting to or from neutral N.

Shifting between forward gears is also referred to as "power shifting", in contrast to shifting between neutral and either the first gear F1 or reverse R. The present inventors have recognized that the NVH problems when power shifting using systems and methods presently known in the art are due in part to the additional demand on the marine propulsion device 1 during a power shift as compared to going to or from neutral. Specifically, the marine propulsion device 1 is typically either stationary, slowing down, or operating at lower speeds and experiencing relatively low drag forces when transitioning into or out of neutral. In contrast, shifting from first gear to second gear means that the vessel is underway and operating at sufficiently high speeds so as to benefit from upshifting to a second or higher gear.

The present inventors have developed calibration and shifting protocols to smooth the transition in shifting gears (including for power shifts), which include instructions for specific timing and pressure targets for controlling the fluid within the clutches to disengage one gear and engage another. However, the present inventors have recognized that the transition for a power shift is not consistent over all times. The shift from first gear F1 to second gear F2 is different for a first shifting instance than subsequent shifting instances for the same gear transition within an operation session or key cycle. Specifically, the present inventors have identified that the first power shift is rough from an NVH perspective when the gear being shifted to has not been engaged for some time (e.g., rough for the first powershift of the day, as compared to later powershifts within that day or within a few hours). Therefore, the same calibration protocols that provide for smooth shifting during all subsequent power shifts do not provide the same smooth operation for this first shifting instance.

Through experimentation and development, the present inventors have recognized that this roughness of the first power shift is caused by a longer than usual gap in the engagement time of transitioning from one forward gear to the next (i.e., when neither gear is engaged), for example shifting from first gear to second gear. The present inventors discovered that this longer gap in engagement time results from an inconsistent starting point for engaging the subsequent gear, here the second gear F2, when comparing a first powershift to later powershifts. Moreover, the present inventors have found that even a very minor increase (e.g., 50 ms) in engagement time over that of normal, subsequent shifts has a significant negative impact on NVH.

This longer gap in engagement time is due to the second clutch C2 containing less fluid at the start of the first shift instance for shifting to second gear F2 than in subsequent shifts to second gear F2, and thus requiring additional time to fill and a longer transition gap. In particular, when the second clutch C2 remains disengaged for a relatively long period of time, the fluid drains out and the clutch pack becomes "dry" relative to the fluid levels after subsequent engagements. This fluid is ultimately restored after the first power shift has completed. However, the additional time to replenish the drained fluid of a dry clutch during the first power shift is sufficiently different that the calibrated shifting protocols designed for all subsequent shifting events so as to cause undesirable NVH performance.

Accordingly, the present inventors have developed the presently disclosed systems and methods to correct the effects of a dry clutch for the first power shift in a time period (e.g., the first shift of a key cycle or day). As is discussed further below, this provides for "wetting" or "pre-filling" a clutch before that clutch is requested to be engaged, thereby eliminating the additional delay of filling during a first engagement of that clutch in the future.

Figure 3:
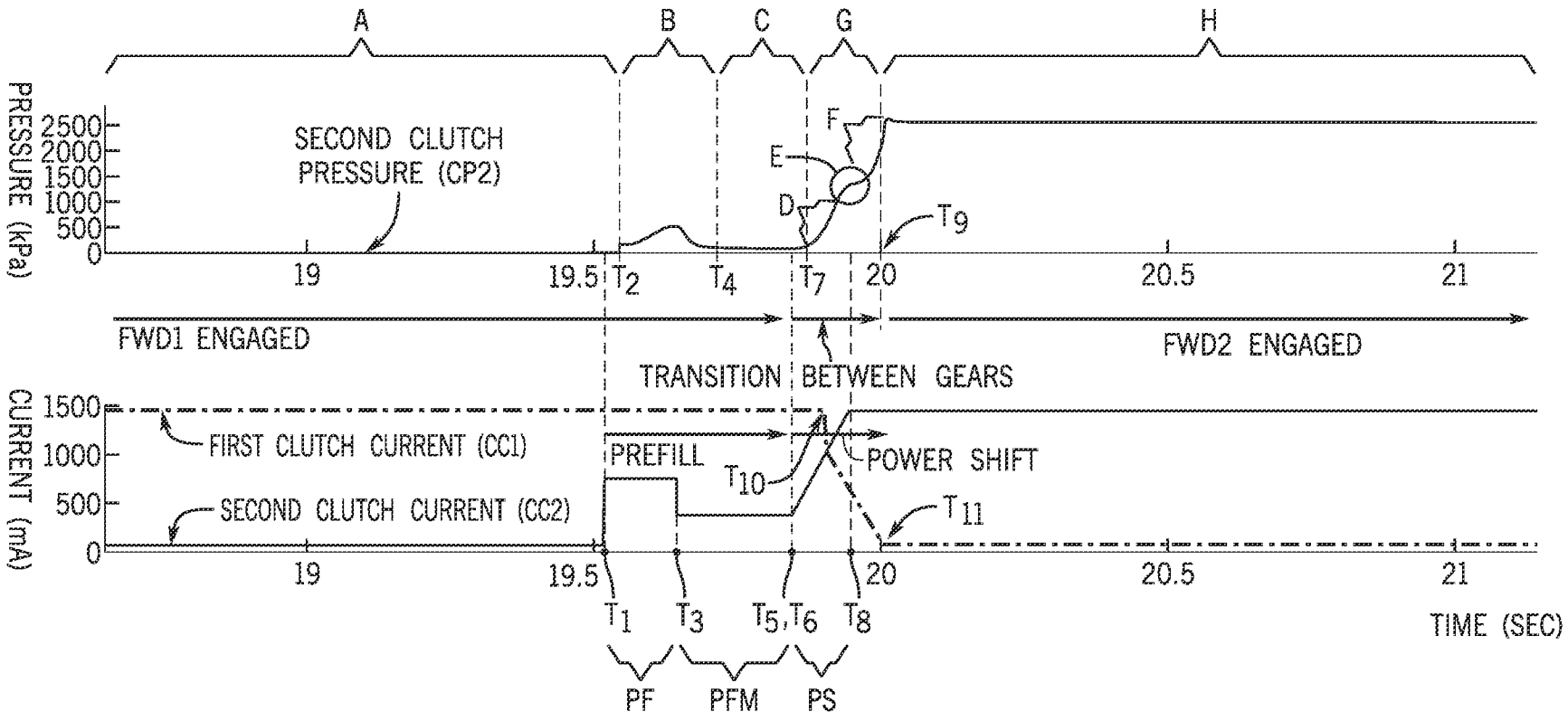
FIG. 3 is a graph depicting exemplary currents and pressures for respective clutches while shifting according to methods presently known in the art.

FIG. 3 shows exemplary data of the currents and pressures associated with the clutches involved in shifting gears for a multi-speed transmission in the manner presently known in the art. These currents and pressures are measured by current sensors 93-95 and pressure sensors 96-98 associated with a first clutch C1, second clutch C2, and reverse clutch CR, respectively, controllable by the controller 9 (see FIG. 2). In particular, the current sensors 93-95 measure the electrical current delivered to solenoid valves within the clutches in a manner known in the art. Likewise, the pressure sensors 96-98 measure the pressure of fluid within the clutches in a manner known in the art. The controller 9, which may be a combination of hardware and software, then measures the electrical current through the solenoid valves and controls the solenoid valves such that the measured electrical current matches the commanded electrical current (exemplified as the clutch current waveforms in FIG. 3). Each solenoid valve has its own current measurement and control so that the electrical current delivered to each of the solenoid valves can be controlled independently. The graphs of FIG. 3 specifically show data corresponding to the first clutch current CC1 for first clutch C1 in engaging first gear F1, and the second clutch current CC2 and second clutch pressure CP2 for second clutch C2 in engaging the second gear F2. As will be discussed in further detail, the graphs depict typical behavior for shifting between the first gear F1 and second gear F2 in a manner known in the art. The currents and pressures of first clutch C1 and second clutch C2 generally proceeds through several phases:

- Phase A is defined when the pressure for the second clutch pressure CP2 is low or approximately zero such the second gear F2 is disengaged while first gear F1 is engaged. Phase A may be considered as having a first pressure for the fluid within the second clutch C2. The shift process then begins when a request to shift from the first gear F1 to the second gear F2 is received at time 1 T1, at which point the second clutch current CC2 increases to perform a calibrated "prefill" in which fluid is injected into the second clutch C2 before shifting the second gear F2 in a manner known in the art. The second clutch current CC2 rises to an upper plateau for a prefill period PF between time 1 T1 and time 3 T3.
- Phase B begins shortly after the increase in the second clutch current CC2 at time 1 T1, whereby the second clutch pressure CP2 starts increasing at time 2 T2 to perform the calibrated pre-fill of the second clutch C2 in preparation for engagement. Phase B may be considered as having a second pressure for the fluid within the second clutch C2 (though the second clutch pressure CP2, or other labelled pressures, need not be flat, such as shown for the pressure profile of FIG. 3).
- After the pre-fill period PF (during which the second clutch current CC2 was delivered at the upper plateau level), the second clutch current CC2 is decreased at time 3 T3 to an intermediate plateau level or "maintenance" level for a prefill maintenance period PFM from time 3 T3 to time 5 T5. Like the prefill period PF, the prefill maintenance period PFM has a predetermined, calibrated duration and current.
- The second clutch pressure CP2 tapers off during the prefill maintenance period PFM until returning to the approximate pressure level of Phase A at time 4 T4, starting Phase C. Phase C may be considered as having a third pressure for the fluid within the second clutch C2, which in the example shown is less than the second pressure during Phase B, but still greater than the first pressure of Phase A.
- The powershift from the first gear F1 to the second gear F2 is started at time 6 T6, coincident with the completion of the pre-fill process at time 5 T5 (both the prefill period PF and the prefill maintenance period PFM). In particular, the second clutch current CC2 is steadily increased between time 6 T6 and time 6 T8 (the power shift period PS) to cause the power shift from first gear F1 to second gear F2.

The second clutch pressure CP2 begins to rise at time 7 T7 as a result of the increased second clutch current CC2 beginning at time 6 T6, ending Phase C. The second clutch pressure CP2 increases over a period denoted as Phase G from time 7 T7 until becoming engaged at time 9 T9. Phase G is further subdivided into Phases D-F, which are discussed further below. It should be recognized that also during Phase G, the first clutch current CC1 is reduced downwardly to zero (starting at time 10 T10) to disengage the first clutch C1 while the second clutch C2 is being engaged, the first clutch current CC1 reaching approximately zero at time 11 T11.

The second clutch current CC2 remains at a fully engaged level after time 8 T8.

Phase H begins at time 9 T9 after the second clutch C2 is engaged, whereby the first clutch pressure CP1 and the second clutch pressure CP2 have plateaued at relatively constant level. The second gear F2 is now engaged and the first gear F1 is now disengaged.

As noted above, the rise in second clutch pressure CP2 during Phase G between time 7 T7 and time 9 T9 can be further subdivided into Phase D, Phase E, and Phase F before the second gear F2 is engaged in Phase H. Phase D and Phase F of the rising second clutch pressure CP2 are relatively linear, which correspond to the second clutch C2 making effective progress in engaging the second gear F2. However, the Phase E has a much lower slope for the increase in pressure over time, which the present inventors have identified as corresponding to the time in which the dry clutch (here second clutch C2) is filling, but not actively progressing in increasing the second clutch pressure CP2 as is necessary to engage the second gear F2. Thus, Phase E is essentially a delay in the shifting time of the second gear F2 that, as discussed above, is not present in subsequent shifts after the second clutch C2 has already been wetted, thereby providing undesirable NVH.

Figure 4:
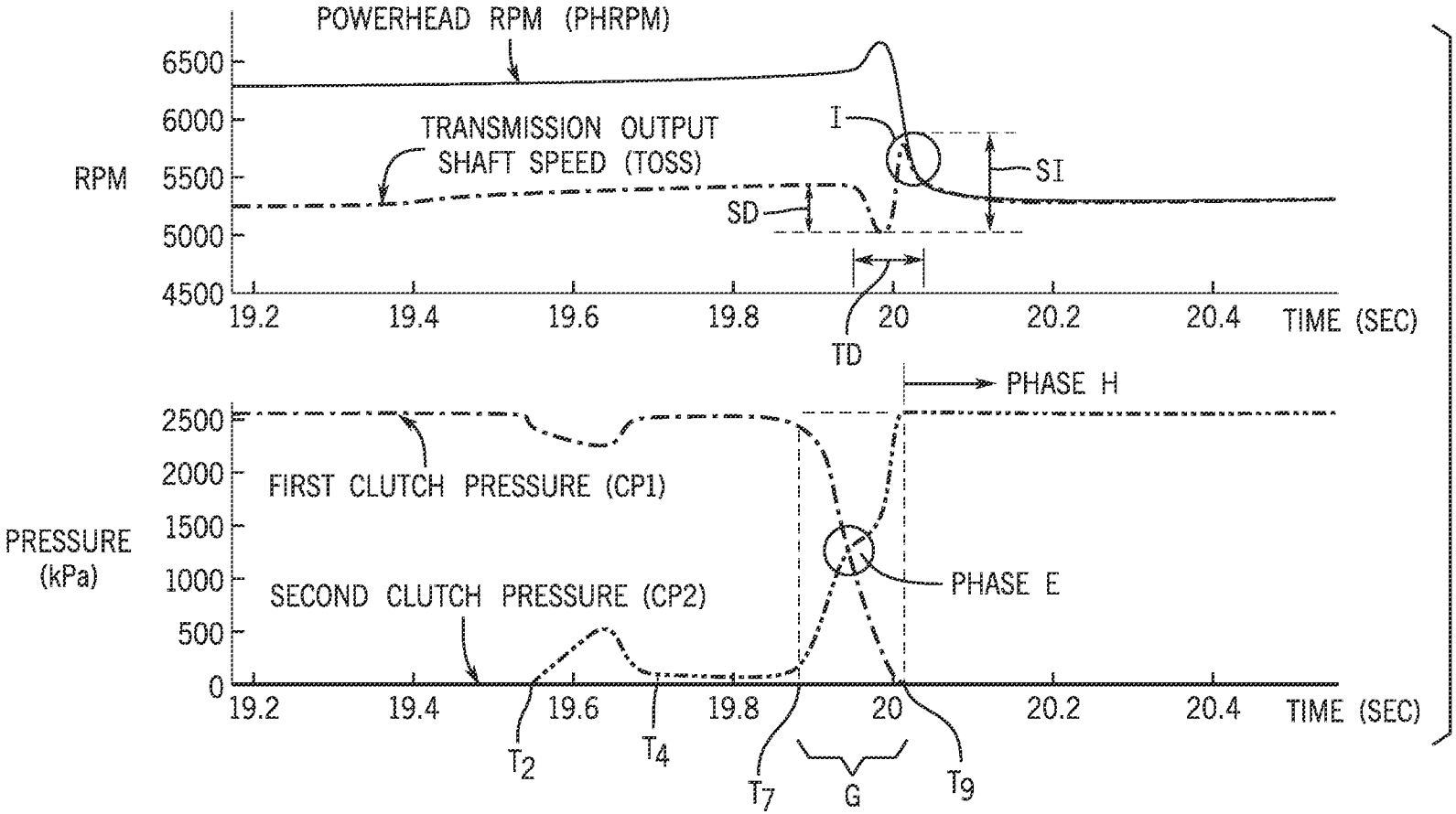
FIG. 4 is a graph depicting exemplary pressures and RPMs for respective clutches while shifting according to methods presently known in the art.

The effects of this delay in engaging the second gear F2 (Phase E in FIG. 3) is further shown in FIG. 4. The top graph of FIG. 4 depicts the powerhead RPM PHRPM and transmission output shaft speed (TOSS) as the transmission 10 shifts between the first gear F1 and the second gear F2. It can be seen that the TOSS decreases during a speed decline period SD while the second gear F2 is in the process of engaging, whereby the TOSS does not return to a steady level (approximately equal to its previous level) for a time delay TD. Moreover, the present inventors have identified that after the TOSS declines, but before leveling out again after this time delay TD, the TOSS undergoes a substantial speed increase SI in which the TOSS rapidly increases from its lowest point to a highest point before settling down again to the previous level before the powershift took place. The speed increase SI is the result of the delay in engaging the second gear F2 after the first gear has been disengaged. In other words, the increased time during Phase E in which the load of the first gear F1 has been removed from the powerhead 2, but not yet replaced with the load of the second gear F2, causes an increase in the powerhead RMP PHRPM and the speed decline SD of TOSS simultaneously. This simultaneous increase of powerhead RPM PHRPM and speed decline SD of TOSS are then abruptly removed, after Phase E, when the second forward gear F2 is engaged and the powerhead 2 once again has load.

The present inventors have recognized that this speed increase SI, also denoted as event I, is a key contributor in the unfavorable NVH that occurs during a first power shift of a dry clutch. As discussed above, while calibration and optimization may be performed to reduce the speed decrease SD, time delay TD, and speed increase SI, the present inventors have recognized that the same calibration routines cannot adequately optimize these variables for both wet and dry clutches, and thus a solution is needed for addressing the rough first power shift of a dry clutch pack.

Through experimentation and development, the present inventors have determined that performing a prefill (i.e., a partial filling) of the second clutch C2 before a request to shift from the first gear F1 to the second gear F2 is effective in "wetting" the second clutch C2. If preemptively wetted, the second clutch C2 is then no longer a dry clutch when a subsequent request to shift to second gear F2 arises. However, this requires ensuring that the wetting prefill is indeed performed before this powershift is requested, and specifically before the standard prefill and shifting shown starting at time 1 T1 of receiving a shift request (see FIG. 3).

To that end, the present inventors have determined that it is advantageous to perform this wetting process shortly after shifting from neutral and into the first gear F1, since a shift to the second gear F2 would not be requested immediately after engaging the first gear F1 (in other words, it takes some time to accelerate through the first gear F1 before needing to upshift to the second gear F2). However, through experimentation and development, the present inventors have also recognized that, for some embodiments of transmission systems, the wetting process is preferably not performed at the same time as the shifting into first gear F1 takes place. Specifically, the present inventors have identified that there may be insufficient pressure in the hydraulic system to effectively perform the shifting into first gear F1 when some amount of pressure is also being provided to wet the second clutch C2.

Figure 5:
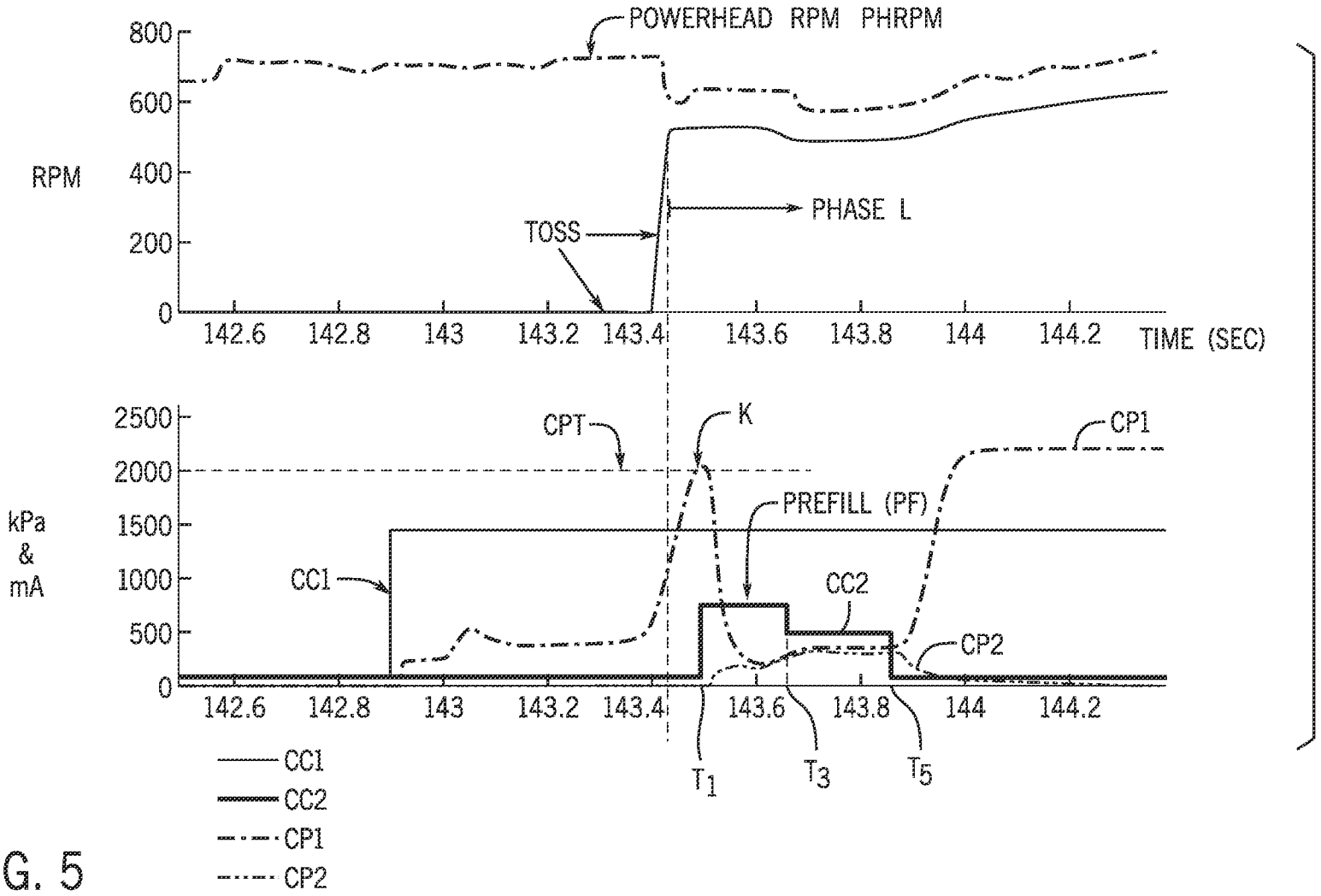
FIG. 5 is a graph depicting exemplary currents, pressures, and RPMs for respective clutches for wetting a clutch according to the present disclosure.

An exemplary process for wetting the second clutch C2 after shifting into the first gear F1 is provided via the graphs of FIG. 5. It should be recognized that this process is referred to throughout the present disclosure as wetting, prefilling, or partially filling of the clutch. The top graph depicts the engagement of the first gear F1 from neutral, whereby the first gear F1 is engaged during Phase L. This engagement of the first gear F1 occurs at approximately 143.4 seconds, at which time the TOSS is shown increasing from approximately zero (corresponding to the marine propulsion device being in neutral) to a non-zero, calibrated engagement valve. The lower chart shows the first clutch current CC1, the second clutch current CC2, the second clutch pressure CP1, and the second clutch pressure CP2 as the transmission 10 shifts into the first gear F1, and subsequently wets the second clutch C2 in preparation for an eventual upshift to the second gear F2.

In certain embodiments, the system determines that the shift to the first gear F1 is complete (or is far enough in the engagement process to begin the wetting prefill process) by monitoring the first clutch pressure CPL. In this example, a predetermined threshold (here a clutch pressure threshold CPT) is provided, whereby when the first clutch pressure CP1 exceeds the clutch pressure threshold CPT, the wetting prefill process of the second clutch C2 is performed. It should be recognized that in other embodiments, an elapsed time after engagement of the first clutch C1 may also or alternatively be used as a trigger to initiate the wetting process for the second clutch C2. In still other embodiments, the wetting process of the second clutch C2 begins at the same time that the first clutch C1 is engaged.

In the example shown in FIG. 5, the clutch pressure threshold CPT is set to approximately 2,000 kPa, which is surpassed by the first clutch pressure CP1 at instance K. At this point, the prefill process of the second clutch C2 begins, for example by delivering a second clutch current CP2 of 600 mA for a period of 1 second, 400 mA for 2 seconds, 1000 mA for 0.5 seconds, or other combinations of current and time insufficient to engage the second clutch C2. In certain embodiments, powershifts incorporate a different, second prefill for engaging the second clutch C2 (e.g., as shown in FIG. 3). In certain examples, the second clutch current CC2, prefill period PD, and/or prefill maintenance period PFM of the first prefill process for wetting, but not engaging, the second clutch C2 may be the same or similar to the prefill shown in FIG. 3 (e.g., but without engagement of the second clutch C2.

The first prefill provides for injecting the fluid into the second clutch C2 for a first predetermined time (e.g., for the prefill period PD and the prefill maintenance period PFM), and the second prefill (when included in a subsequent power shift) takes place over a second predetermined time. The first and second predetermined times may be the same or different (e.g., the predetermined times being within 20 percent of each other). In examples in which the fluid is injected by controlling a current delivered to a given clutch for a given amount of time, the time for delivering the current is also referred to as a current delivery time (e.g., a first current for a first current delivery time to complete the prefill period PF, and a second current for a second current delivery time to complete the prefill maintenance period PFM).

In the example of FIG. 5, time 1 T1 starts when the first clutch pressure CP1 exceeds the clutch pressure threshold CPT at instance K. The (first) prefill then proceeds in a similar manner to that previously discussed, having a prefill period PF with the second clutch current CC2 being delivered at a first current level for a first current delivery time, followed by a prefill maintenance period PFM from time 3 T3 to time 5 T5 withe second clutch current CC2 being delivered at a second current level for a second current delivery time. After time 3 T3, the second clutch current CC2 once again returns to a lower plateau near zero mA.

In certain embodiments, the prefill process is configured, using empirically derived data, such that the second clutch C2 is prefilled to 90% volume with fluid, which the present inventors have found to be sufficient to wet the clutch, but not enough to increase pressure enough to cause engagement of the second clutch C2. However, it should be recognized that other percentages for filling the clutch with hydraulic fluid, such as 80%, 75%, 70%, or even lower (e.g., 50%), can also wet the clutch and are thus also anticipated by the present disclosure. Filling by volume can be inferred by filling for predetermine time periods as discussed above, and/or using sensors to measure the actual volume of the fluid delivered to the clutch. Likewise, the prefill process can also or alternatively be configured to fill until a percentage of the second clutch pressure CP2 needed for engagement is achieved, for example 90%, 80%, 75%, 70%, or 50%. After the prefill process depicted in FIG. 5 has been completed, the second clutch C2 has become wet and is ready for a subsequent request for shifting from first gear F1 to second gear F2, which will now behave in the same manner for a first power shift as in all subsequent power shifts.

Figure 6:
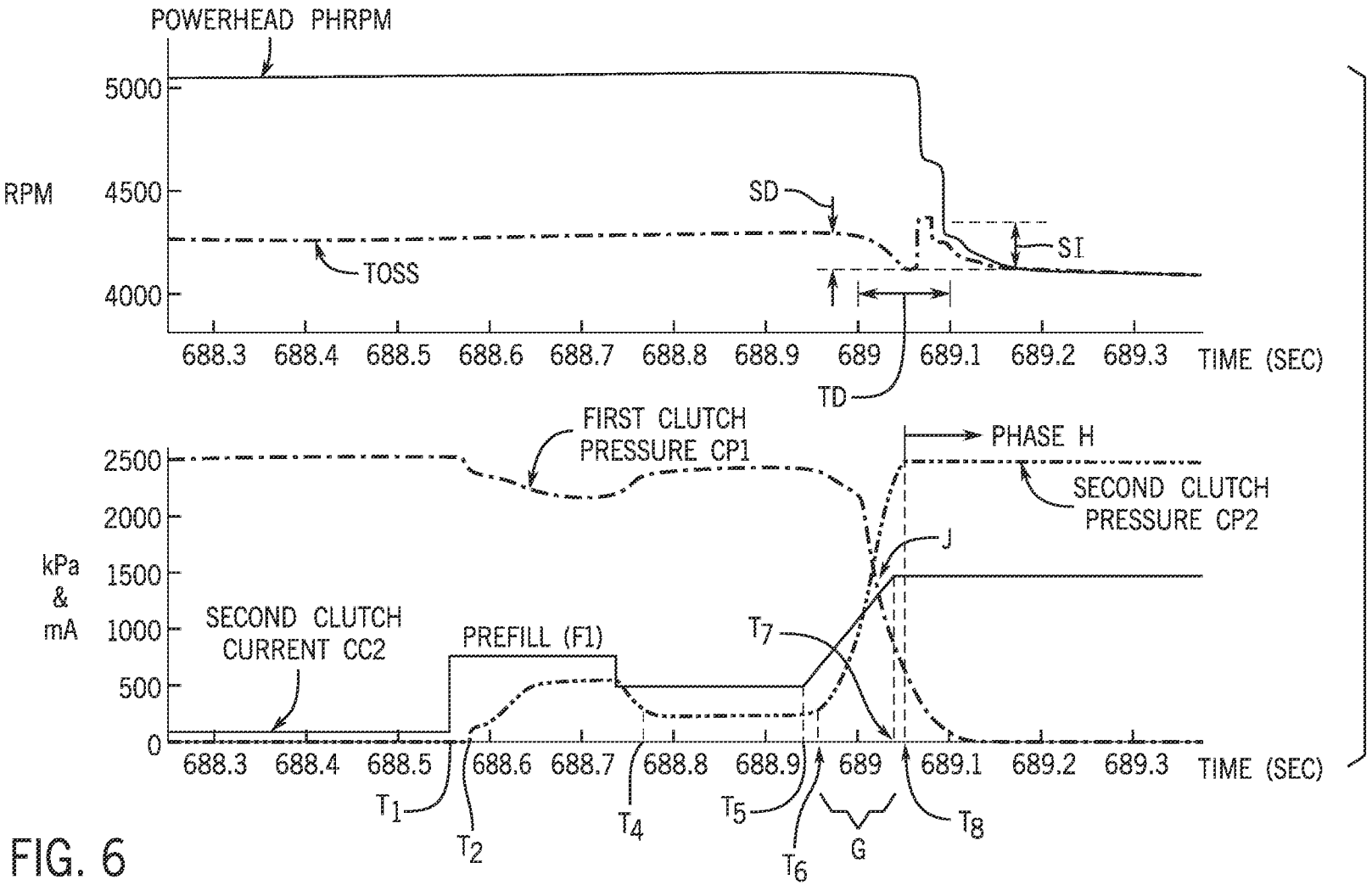
FIG. 6 is a graph depicting exemplary pressures and RPMs for respective clutches while shifting after wetting the clutch as depicted in FIG. 5.

FIG. 6 depicts charts similar to that of FIG. 4, but now depicting a power shift from the first gear F1 to the second gear F2 after a wetting process according to the present disclosure has already been completed (e.g., at some point following the prefill FIG. 5). It can be seen that Phase E, which for a first power shift using systems and methods presently known in the art corresponded to a prominent delay within Phase G of the power shift (e.g., FIG. 4), is no longer present. In other words, there is no longer a delay and pressure plateau between initiating engagement of the second clutch C2 and the second clutch C2 actually engaging. Consequently, it can also be seen that the TOSS shown in the upper graph now has a smaller speed decline SD and smaller speed increase SI as compared to the prior art shifting of FIG. 4. These reductions correspond to the elimination of the NVH concerns identified as existing in present systems and methods. In certain examples, the time delay TD may also be reduced, though this is not necessary for improving the NVH using the systems and methods presently disclosed.

It should be recognized that while the present disclosure generally describes a shift from first gear F1 to second gear F2, the same wetting procedure can also be applied to higher gears if present (e.g., a power shift from the second gear F2 to a third gear) to also prevent NVH issues with subsequent shifts thereto.

Figure 7:
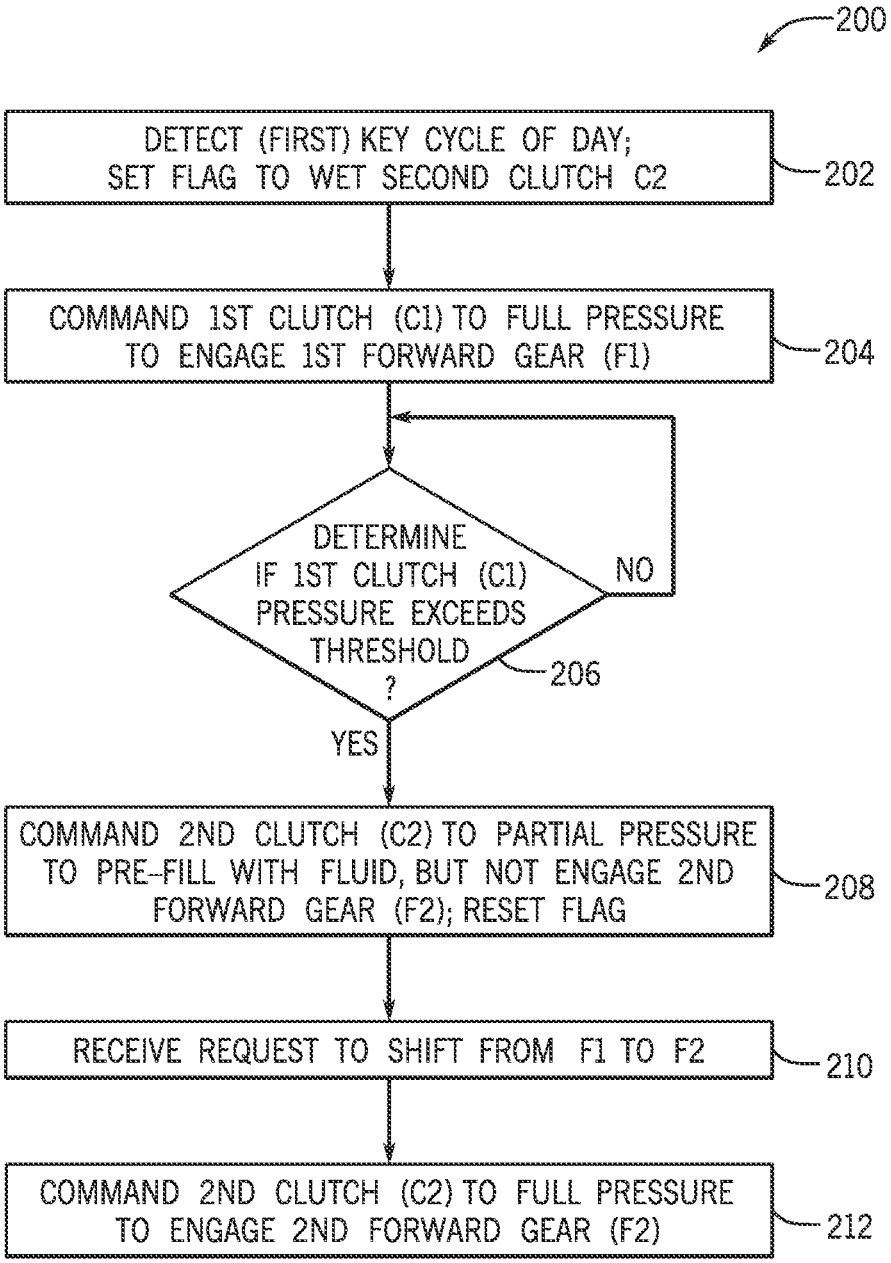
FIG. 7 is an exemplary method for shifting a multi-speed transmission according to the present disclosure, including wetting the clutch.

FIG. 7 depicts an exemplary method for wetting the second clutch C2 in accordance with the present disclosure, such as shown in FIG. 5. Through experimentation and development, the present inventors have recognized that in some circumstances the second clutch C2 need only be wetted a single time per day, whereby enough fluid remains in the second clutch C2 that the standard power shifting process is well-suited for smooth transitions in all subsequent power shifts of that day. In the method 200 shown, step 202 provides for detecting a key cycle (which in some cases may be specifically the first key cycle of the day), which sets a flag to allow the wetting process to occur when ready, as discussed below. Step 204 provides for commanding the first clutch C1 to engage the first forward gear F1, such as previously shown in FIG. 5. Step 206 then provides for determining whether the first clutch C1 pressure exceeds a threshold, such as the clutch pressure threshold CPT previously discussed in FIG. 5. In alternative embodiments, a time threshold may be provided in addition to, or as an alternative to, the clutch pressure threshold CPT to ensure that the shift to first gear F1 has completed, or is sufficiently underway such that diverting pressure to wet the second clutch C2 does not have a detrimental impact on the timing of shifting to the first gear F1.

If it is determined in step 206 that the first clutch pressure CP1 and/or timing does not exceed the threshold, the process continues until such determination is deemed affirmative. Once affirmative, the method 200 proceeds with step 208, which calls for commanding the second clutch C2 to partially fill (prefill) the second clutch C2 with fluid, but not enough to engage the second gear F2. As previously discussed, this step may be calibrated to provide a 90% volume fill for the clutch, or other fill levels depending on the particular transmission and clutches involved. The flag indicating that wetting is needed (initially set in Step 202) is also reset, thereby preventing the wetting process from repeating multiple times when unnecessary. Other embodiments could also execute the wetting operation once per day, once after each key cycle, once after a predetermined time has passed since the last wetting operation, or on every transition from neutral to the first gear F1, for example. In further embodiments, the wetting process is limited by pressure and/or volume measurements as a safeguard to prevent over-filling the fluid in the second clutch C2 during the wetting operation.

In certain embodiments, the method 200 further includes an optional flush phase to ensure that the fluid level within the second clutch C2 remains sufficiently low so as to not become engaged. The pressure of the fluid within the second clutch C2 during the flush may be considered as a fourth pressure that is less than the third pressure of Phase C discussed above (see FIG. 3). However, the present inventors have recognized that this flush step is not required in most embodiments due to the calibrated fill amount of the wetting prefill (and standard prefill) processes.

Continuing with FIG. 7, step 210 then provides for receiving a request to shift from first gear F1 to second gear F2, which now is requested of a wetted second clutch C2 rather than a dry second clutch C2 (i.e., if this is the first power shift of the day or extended time period). Step 212 then concludes with commanding the second clutch C2 to full pressure to engage the second forward gear F2, which will now shift without the NVH issues observed in systems and methods presently known in the art.

The present inventors have identified that certain modes for operating the marine propulsion device may results in rapid gear changes between the first gear F1 and the second gear F2, which could potentially lead to excess fluid within the second gear F2 during prefilling operations. Therefore, certain embodiments provide that the second clutch C2 is prefilled every time the transmission shifts from neutral to first gear F1, but only if that shift was originated by moving a conventional throttle lever for the marine vessel. Other causes of shifting from neutral to the first gear F1 include various automatic operating modes, (e.g., Brunswick Corporation's Skyhook feature, discussed in U.S. Pat. No. 10,000,268, which is incorporated by reference herein), or joystick-based operation (additional information regarding throttle levers and joystick operating modes is provided in U.S. Pat. Nos. 6,763,850; 8,925,414; and 9,248,898, which are incorporated by reference herein). The present inventors have recognized that throttle lever-based shifts are typically less rapid and less frequent as compared to automatic operating modes and/or shifts triggered by a joystick operating mode. In these faster shifting modes, shifting may occur so quickly that the second gear F2 does not sufficiently drain between prefill operations, potentially causing overfilling, engagement, and/or fault states.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

Figure 8:
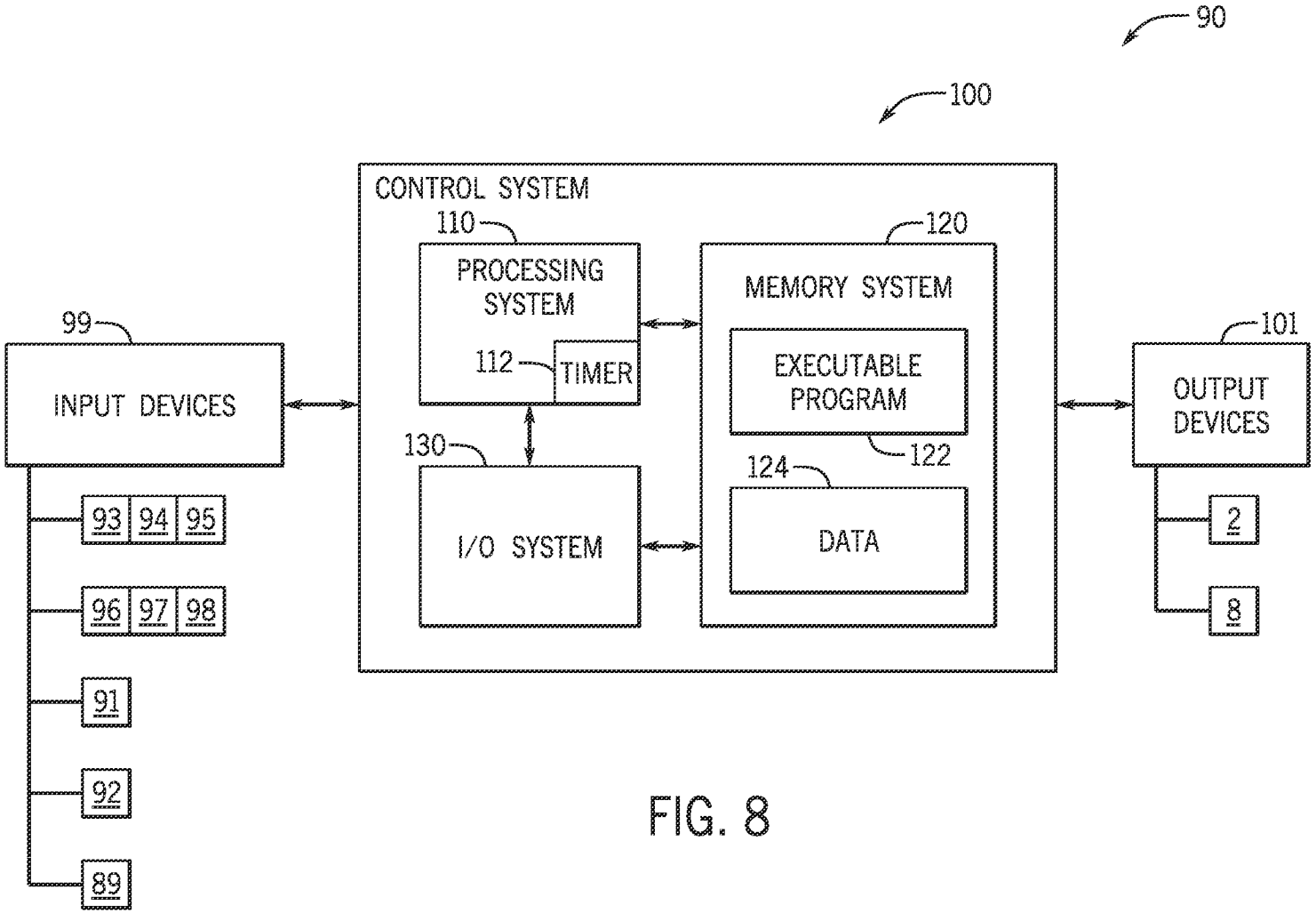
FIG. 8 is a schematic view of an exemplary control system for shifting a transmission and wetting a clutch according to the present disclosure.

Additional information is now provided for the controller 9 shown in FIGS. 1 and 2, which may be configured like the control system 100 of FIG. 8. A person of ordinary skill in the art will understand in light of the disclosure that the control system 100 may include a differing set of one or more control modules, or control devices, which may include engine control modules (ECMs) for each marine propulsion device 1 (which will be referred to as ECMs even if the marine propulsion device 1 contains an electric motor in addition to or in place of an internal combustion engine), one or more thrust vector control modules (TVMs), one or more helm control modules (HCMs), and/or the like. Additional information regarding ECMs, TVMs, HCMs, and communication therebetween is provided in U.S. Pat. Nos. 9,994,296; 9,975,619; and 10,594,510, which are incorporated by reference herein.

In certain examples, the control system 100 communicates with each of the one or more components of the system 90 via a communication link CL, which can be any wired or wireless link. The control system 100 is capable of receiving information and/or controlling one or more operational characteristics of the system 90 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system 90. Moreover, the communication link CL lines are meant only to demonstrate that the various control elements are capable of communicating with one another, and do not represent actual wiring connections between the various elements, nor do they represent the only paths of communication between the elements. Additionally, the system 90 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101. Input devices 99 may include the current sensors 93-95 and pressure sensors 96-98 associated with a first clutch C1, second clutch C2, and reverse clutch CR, respectively, the TOSS sensor 92, and the RPM sensor 91, for example (FIG. 1). A throttle position sensor 89 may also be provided as an input device 99, such as disclosed in U.S. Pat. Nos. 6,763,850; 8,925,414; and U.S. Pat. No. 9,248,898 (discussed above). The throttle position sensor 89 allows the system 90 to determine when the throttle lever has moved, which as discussed above may dictate whether the second clutch C2 is automatically prefilled after the transmission 10 shifts from neutral N to the first gear F1. Output devices 101 may include the clutch actuator 8 for actuating the clutches (i.e., to engage and disengage the various gears), and/or the powerhead 2 (e.g., an ECM or TVM therein), for example. It should be recognized that the ECM, TVM, and/or HCM of the marine vessel may serve as inputs, outputs, or both for the control system 100.

The processing system 110 loads and executes an executable program 122 from the memory system 120, accesses data 124 stored within the memory system 120, and directs the system 90 to operate as described in further detail below. A timer 112 is also provided, shown here in conjunction with the processing system 110, which is configured to count an elapsed time between starting and stopping of the timer 112, for example.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. Examples of information within the data 124 includes currents, times, pressures, and/or volumes for executing prefills of the clutches during the prefill period FM, prefill maintenance period PFM, powershift PS, or any other phases before and after executing prefills and shifts (e.g., Phase A through Phase L; e.g., as shown in FIGS. 3-6). The data 124 may also include the clutch pressure threshold CPT for comparing to the first clutch pressure CP1 to determine when to begin the prefill process for the second clutch C2 (see FIG. 5).

The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The following provides additional information regarding exemplary systems and/or methods according to the present disclosure.

One embodiment relates to a method for shifting a transmission of a marine propulsion device having a powerhead that rotates a driveshaft, the transmission having an input shaft rotated by the driveshaft, and the transmission having first and second clutches for selectively rotatably coupling first and second gears to the input shaft. The method includes determining when the first gear has been engaged via the first clutch and increasing a pressure of fluid within the second clutch, after the first gear is determined to be engaged, from a first pressure to a second pressure, where the second pressure is insufficient to engage the second clutch. The method further includes receiving a request to shift from the first gear to the second gear, and increasing the pressure of the fluid within the second clutch to a third pressure greater than the second pressure to engage the second gear.

In certain embodiments, the method further includes decreasing a pressure of fluid within the first clutch to disengage the first gear after receiving the request to shift from the first gear to the second gear and before engaging the second gear.

In certain embodiments, the method further includes monitoring the pressure of the fluid within the first clutch and waiting until the pressure exceeds a threshold before increasing the pressure of the fluid within the second clutch to the second pressure.

In certain embodiments, the method further includes reducing the pressure within the second clutch to a fourth pressure between increasing to the second pressure and increasing to the third pressure, wherein the fourth pressure is less than the second pressure.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for shifting a multi-speed transmission of a marine propulsion device from a first gear being engaged to a second gear being engaged by selectively filling a first clutch and a second clutch with a fluid, the method comprising:

operating the marine propulsion device with the second gear disengaged;

controlling the second clutch to perform a first prefill in which fluid is injected into the second clutch to partially fill the second clutch while the second gear remains disengaged; and receiving, after the first prefill, a request to shift from the first gear to the second gear and subsequently increasing a pressure in the second clutch to cause the second gear to engage and decreasing a pressure in the first clutch to cause the first gear to disengage to thereby shift the multi-speed transmission.

2. The method according to claim 1, further comprising, after receiving the request to shift to the second gear and before increasing the pressure in the second clutch to engage the second gear, performing a second prefill in which the fluid is injected into the second clutch to partially fill the second clutch while the second gear remains disengaged.

3. The method according to claim 2, wherein performing the first prefill comprises injecting the fluid for a first predetermined time, wherein performing the second prefill comprises injecting the fluid for a second predetermined time, and wherein the first predetermined time is within 20 percent of the second predetermined time.

4. The method according to claim 1, wherein the fluid in the second clutch has a first volume after the first prefill and a second volume when the second gear becomes engaged, and wherein the first volume is between 50 and 90 percent of the second volume.

5. The method according to claim 1, wherein the first prefill is performed by increasing a current delivered to the second clutch to a first current for a first current delivery time, further comprising reducing the current delivered to the second clutch after the first current delivery time to a second current.

6. The method according to claim 5, wherein the first current and the second current are each insufficient to cause the second clutch to engage the second gear.

7. The method according to claim 5, wherein the current is delivered to the second clutch at the second current for a second current delivery time, further comprising reducing the current delivered to the second clutch after the second current delivery time to a third current.

8. The method according to claim 7, wherein the third current is equal to the current delivered to the second clutch before the first prefill.

9. The method according to claim 1, further comprising performing the first prefill after receiving a request to shift from neutral to the first gear.

10. The method according to claim 9, further comprising monitoring the pressure in the first clutch and performing the first prefill after determining that the pressure in the first clutch exceeds a predetermined threshold.

11. The method according to claim 10, wherein the first gear engages when the pressure in the first clutch reaches an engagement pressure, and wherein the predetermined threshold for the first clutch is at least 80 percent of the engagement pressure.

12. The method according to claim 1, further comprising tracking an elapsed time since the second gear was last engaged, comparing the elapsed time to a time threshold, and performing the first prefill when the elapsed time exceeds the time threshold.

13. The method according to claim 1, further comprising detecting a startup event for the marine propulsion device, and further comprising performing the first prefill once after each startup event.

14. A multi-speed transmission for a marine propulsion device, the multi-speed transmission being configured to transmit torque from a powerhead to a propulsor, the multi-speed transmission comprising:

a first gear and a second gear each engageable to transmit the torque between the powerhead and the propulsor;

a first clutch configured to engage the first gear when a pressure in the first clutch reaches a first engagement threshold;

a second clutch configured to engage the second gear when a pressure in the second clutch reaches a second engagement threshold; and a control system operatively coupled to the first clutch and the second clutch, wherein the control system is configured to control the pressure in the first clutch and in the second clutch, wherein the control system is further configured to:

control the second clutch, while the second gear is disengaged, to perform a first prefill in which fluid is injected into the second clutch to partially fill the second clutch while the second gear remains disengaged; and receive, after the first prefill, a request to shift to the second gear and to subsequently increase the pressure in the second clutch to cause the second gear to engage and decrease the pressure in the first clutch to cause the first gear to disengage to thereby shift the multi-speed transmission.

15. The multi-speed transmission according to claim 14, wherein the control system is further configured to, after receiving the request to shift to the second gear and before increasing the pressure in the second clutch to engage the second gear, perform a second prefill in which the fluid is injected into the second clutch to partially fill the second clutch while the second gear remains disengaged.

16. The multi-speed transmission according to claim 14, wherein the control system is configured to control a current delivered to the second clutch, and wherein the first prefill is performed by increasing the current delivered to the second clutch to a first current for a first current delivery time, and wherein the control system is further configured to reduce the current delivered to the second clutch after the first current delivery time to a second current.

17. The multi-speed transmission according to claim 14, wherein the control system is configured to perform the first prefill after receiving a request to shift from neutral to the first gear.

18. The multi-speed transmission according to claim 17, further comprising a pressure sensor configured to measure the pressure in the first clutch, the pressure sensor being operatively coupled to the control system, wherein the control system is further configured to monitor the pressure in the first clutch and control the second clutch to perform the first prefill after determining that the pressure in the first clutch exceeds a predetermined threshold.

19. The multi-speed transmission according to claim 14, further comprising configuring the control system to track an elapsed time since the second gear was last engaged, to compare the elapsed time to a time threshold, and to control the second clutch to perform the first prefill when the elapsed time exceeds the time threshold.

20. The multi-speed transmission according to claim 14, further comprising configuring the control system to detect a startup event for the marine propulsion device, and to control the second clutch to perform the first prefill once after each startup event.

* * * * *